US012378857B1

(12) United States Patent
Al Fardan

(10) Patent No.: US 12,378,857 B1
(45) Date of Patent: Aug. 5, 2025

(54) SYSTEMS AND METHODS FOR MULTIPHASE FORMATION FLUID PRODUCTION UTILIZING AN ELECTRIC SUBMERSIBLE PUMP

(71) Applicant: Saudi Arabian Oil Company, Dhahran (SA)

(72) Inventor: Ali Al Fardan, Al Qatif (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/659,222

(22) Filed: May 9, 2024

(51) Int. Cl.
*E21B 43/12* (2006.01)
*E21B 33/04* (2006.01)
*E21B 43/38* (2006.01)

(52) U.S. Cl.
CPC ..... *E21B 43/128* (2013.01); *E21B 33/04* (2013.01); *E21B 43/38* (2013.01)

(58) Field of Classification Search
CPC ..... E21B 43/121; E21B 43/128; E21B 33/122
See application file for complete search history.

(56) References Cited

U.S. PATENT DOCUMENTS 3,765,483 A * 10/1973 Vencil ..... E21B 43/126 166/54.1
4,098,335 A 7/1978 Goad
4,266,607 A * 5/1981 Halstead ..... E21B 43/128 166/371
4,589,482 A * 5/1986 Bayh, III ..... E21B 34/105 166/321
4,621,689 A * 11/1986 Brookbank, III ..... E21B 43/128 166/106
4,832,127 A * 5/1989 Thomas ..... E21B 41/02 417/431

(Continued)

FOREIGN PATENT DOCUMENTS

CN 110593846 A 12/2019
CN 218092945 U 12/2022

OTHER PUBLICATIONS

Prabhu et al., "Application of Dual ESP Completion with Remote Monitoring in Offshore Wells Having Variable Flow Conditions", Society of Petroleum Engineers, SPE-206902-MS, 2022.

(Continued)

*Primary Examiner* — Robert E Fuller
(74) *Attorney, Agent, or Firm* — DINSMORE & SHOHL LLP

(57) ABSTRACT

A system for producing a multiphase formation fluid from a subsurface formation may comprise a surface collection point; a power source positioned at the surface collection point; a wellbore extending from the surface collection point to the subsurface formation; a packer positioned within the wellbore, the packer defining a first cavity and a second cavity; an electric submersible pump (ESP) comprising an ESP inlet end and an ESP outlet end; a gas separator coupled to the ESP inlet end; a first tubing string coupled to the top surface of the packer at the first cavity; a second tubing string coupled to the top surface of the packer at the second cavity; and one or more power cables extending from the power source through the second tubing string and second cavity to the ESP, the one or more power cables electrically coupled to the ESP and the power source.

19 Claims, 1 Drawing Sheet

(56) References Cited

U.S. PATENT DOCUMENTS

| | | | | |
|---|---|---|---|---|
| 5,657,821 | A * | 8/1997 | Beauquin | E21B 43/12 166/97.5 |
| 5,947,206 | A * | 9/1999 | McCalvin | E21B 34/10 166/324 |
| 6,092,599 | A * | 7/2000 | Berry | E21B 43/121 166/54.1 |
| 6,179,056 | B1 | 1/2001 | Smith | |
| 10,823,177 | B2 | 11/2020 | Sheth et al. | |
| 11,047,198 | B2 | 6/2021 | Ross | |
| 12,078,041 | B1 * | 9/2024 | Fardan | E21B 43/38 |
| 2008/0245525 | A1 * | 10/2008 | Rivas | E21B 43/128 166/105.5 |
| 2010/0089588 | A1 * | 4/2010 | Thompson | E21B 43/38 166/372 |

OTHER PUBLICATIONS

RMS Pumtools, "Dual Concentric/Multiple Zone", https://www.rmspumptools.com/products/completion-systems-intervention-tools/esp-dual-bypass-systems/dual-concentricmultiple-zone, 2024.

* cited by examiner

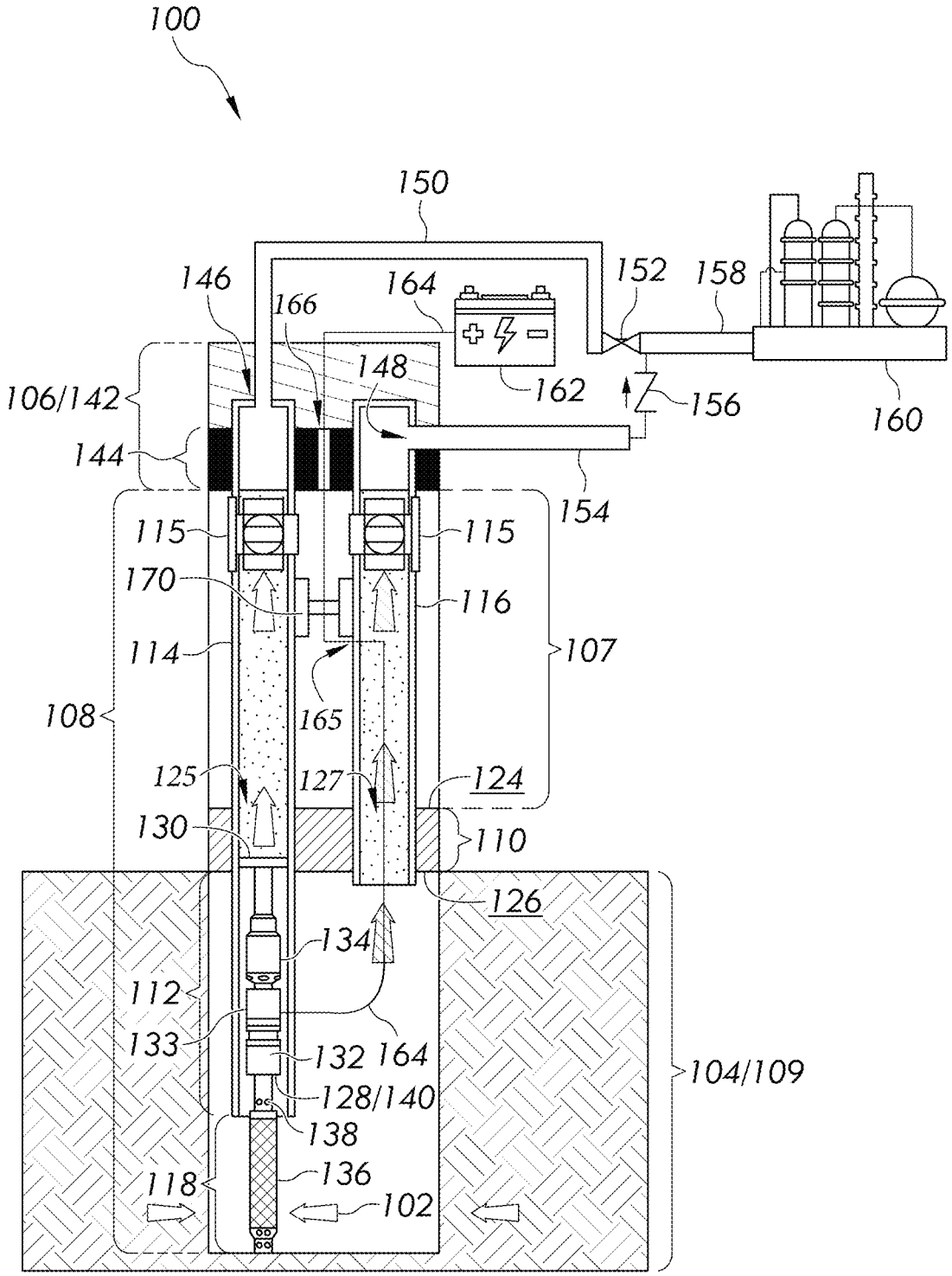
100
150
146
166
164
152
158
162
148
156
160
106/142
144
154
115
115
170
116
114
107
108
165
125
127
124
130
110
126
134
112
133
132
164
104/109
128/140
138
136
118
102

SYSTEMS AND METHODS FOR MULTIPHASE FORMATION FLUID PRODUCTION UTILIZING AN ELECTRIC SUBMERSIBLE PUMP

TECHNICAL FIELD

Embodiments herein generally relate to systems and methods for multiphase formation fluid production, and particularly to systems and methods for multiphase formation fluid production utilizing an electric submersible pump in a subsurface formation.

BACKGROUND

Electric submersible pumps (ESP) are a common method of artificial lift used to efficiently extract large quantities of multiphase formation fluids (water, oil, and gas) from hydrocarbon-bearing subsurface formations. However, electric submersible pumps are known to struggle with producing formation fluids with a large ratio of gas, such that the choice of an electric submersible pump may not be desired in such formations. Particularly Electric submersible pumps operating in high gas/oil ratio formations are prone to a phenomenon referred to as 'gas locking', in which a gaseous phase of the multiphase formation fluid separates and occupies a predominant portion of the electric submersible pump. The electric submersible pump may then repeatedly compress and decompress the gaseous phase without properly passing the gas through electric submersible pump, resulting in loss of production, damage to the pump, or both.

SUMMARY

Accordingly, systems and methods are desired to allow the use of electric submersible pumps in subsurface formations, and particularly in high gas/oil ratio subsurface formations, without the risk of reduced production or damage to the pump due to gas locking. Embodiments herein address the aforementioned need by placing a gas separator on the inlet end of the ESP placed within a wellbore, such that at least a portion of the gaseous phase of the multiphase formation fluid will be separated prior to entry into the ESP and sent into the wellbore.

However, the separated gaseous phase still needs a flow path to the surface, otherwise the gradual buildup of gas will eventually overwhelm the gas separator and ESP. Accordingly, the separated gaseous phase may be given a pathway up the annulus of the wellbore (the area between the casing and the ESP/associated tubing). However, this solution also comes with drawbacks. Traditional casings used to line wellbores are ordinarily made with grades of iron that may be vulnerable to corrosion, such as from corrosive species present in the multiphase formation fluid. Progressive corrosion to the casing may risk wellbore integrity, potentially resulting in the loss of the well or reduced production. Corrosive resistant grades of casing or chemical-based corrosion treatment may be used, but this adds additional cost.

Accordingly, systems and methods are desired to allow the use of electric submersible pumps in subsurface formations, and particularly in high gas/oil ratio subsurface formations, without utilizing the wellbore annulus to produce the gaseous phase. Systems and methods herein address the aforementioned need by providing two tubing strings for separately producing the liquid phase and the gaseous phase of the multiphase formation fluid. This is accomplished by providing a packer with fastening means for the two tubing strings, the first tubing string having the ESP and gas separator below the packer, and the second tubing string being open-ended. The packer may then be actuated to isolate an upper section of the wellbore above the packer and a lower section of the wellbore below the packer. Accordingly, the only permitted flow paths of the multiphase formation fluid are either through the first or second tubing strings. This removes the need to produce the separated gaseous phase through the annulus while also reducing the chance of gas locking.

In accordance with one embodiment herein, a system for producing a multiphase formation fluid from a subsurface formation utilizing an electric submersible pump may comprise a surface collection point; a power source positioned at the surface collection point; a wellbore extending from the surface collection point to the subsurface formation; a packer positioned within the wellbore, the packer defining a first cavity and a second cavity, both the first cavity and the second cavity extending from a top surface of the packer to a bottom surface of the packer; the electric submersible pump (ESP) comprising an ESP inlet end and an ESP outlet end; a gas separator comprising a multiphase formation fluid inlet, a gaseous phase outlet, and a liquid phase outlet, the liquid phase outlet coupled to the ESP inlet end; a first tubing string coupled to the top surface of the packer at the first cavity; a second tubing string coupled to the top surface of the packer at the second cavity; and one or more power cables extending from the power source through the second tubing string and second cavity to the ESP, the one or more power cables electrically coupled to the ESP and the power source.

In at least the previous embodiment, the ESP outlet end may be coupled to the bottom surface of the packer at the first cavity and the liquid phase outlet of the ESP may be coupled to the ESP inlet end. Further, the first tubing string, the ESP, and the gas separator may together define a first fluid pathway from the multiphase formation fluid inlet to the surface collection point and the second tubing string and the packer may together define a second fluid pathway from the bottom surface of the packer to the surface collection point. Further yet, the gas separator may be configured to separate a gaseous phase of the multiphase formation fluid to produce the gaseous phase through the second tubing string to the surface collection point, and the ESP may be configured to produce a liquid phase of the multiphase formation fluid from the subsurface formation through the gas separator and the first tubing string to the surface collection point.

BRIEF DESCRIPTION OF THE SEVERAL VIEWS OF THE DRAWINGS

The following detailed description of specific embodiments herein can be best understood when read in conjunction with the following drawings, where like structure is indicated with like reference numerals and in which:

FIG. 1 illustrates a wellbore diagram with the system as described in embodiments herein.

These and other aspects of the present methods are described in further detail below with reference to the accompanying figures, in which one or more illustrated embodiments and/or arrangements of the systems and methods are shown. In the description of the embodiments that follows, like numerals denote like components across the various FIGURES. The systems and methods of the present application are not limited in any way to the illustrated embodiments and/or arrangements. It should be understood that the systems and methods as shown in the accompanying FIGURES are merely exemplary of the systems and methods of the present application, which can be embodied in various forms as appreciated by one skilled in the art. Therefore, it is to be understood that any structural and functional details disclosed herein are not to be interpreted as limiting the present systems and methods, but rather are provided as a representative embodiment and/or arrangement for teaching one skilled in the art one or more ways to implement the present systems and methods.

DETAILED DESCRIPTION

Embodiments herein generally relate to systems and methods for multiphase formation fluid production, and particularly to systems and methods for multiphase formation fluid production utilizing an electric submersible pump in a subsurface formation. The methods and systems herein are described, in some instances, in the context of the subsurface formations of FIG. 1. However, it should be understood that the methods and systems described herein may have applicability with other subsurface formations than are illustrated in FIG. 1, as would be appreciated by those skilled in the art.

As used herein, the terms "downhole" and "uphole" may refer to a position within a wellbore relative to the surface, with uphole indicating a direction or position closer to the surface and downhole referring to a direction or position farther away from the surface. Similarly, as used herein, the terms "downward" and "upward" may refer to a position within a subterranean environment or subsurface formation relative to the surface, with upward indicating a direction or position closer to the surface and downward referring to a direction or position farther away from the surface.

As described herein, a "subsurface formation" may refer to a body of rock that is continuous and sufficiently distinctive from the surrounding rock bodies that the body of the rock may be mapped as a distinct entity. A subsurface formation is, therefore, sufficiently homogenous to form a single identifiable unit containing similar properties throughout the subsurface formation, including, but not limited to, porosity and permeability.

As used herein, "wellbore," may refer to a drilled hole or borehole extending from the surface of the Earth down to the subsurface formation, including the openhole or uncased portion. The wellbore may form a pathway capable of permitting fluids to traverse between the surface and the subsurface formation. The wellbore may include at least a portion of a fluid conduit that links the interior of the wellbore to the surface. The fluid conduit connecting the interior of the wellbore to the surface may be capable of permitting regulated fluid flow from the interior of the wellbore to the surface and may permit access between equipment on the surface and the interior of the wellbore.

As used herein, a "wellbore wall" may refer to the interface through which fluid may transition between the subsurface formation and the interior of the wellbore. The wellbore wall may be unlined (that is, bare rock or formation) to permit such interaction with the subsurface formation or lined, such as by a tubular string, to prevent such interactions. The wellbore wall may also define the void volume of the wellbore.

Referring now to FIG. 1, a wellbore diagram of a system 100 for producing a multiphase formation fluid 102 is illustrated. As shown in FIG. 1, the system 100 may comprise a subsurface formation 104, a surface collection point 106, a wellbore 108, a packer 110, an electric submersible pump 112, a first tubing string 114, a second tubing string 116, and a gas separator 118.

As previously stated, the system 100 may comprise the subsurface formation 104, the surface collection point 106, and the wellbore 108. As shown in FIG. 1, the wellbore 108 may extend from the surface collection point 106 to the subsurface formation 104. Also as shown in FIG. 1, the subsurface formation 104 may comprise and/or contain the multiphase formation fluid 102. The multiphase formation fluid 102 may comprise a liquid phase and a gaseous phase. The liquid phase may comprise liquid hydrocarbons and/or water. The gaseous phase may comprise hydrocarbon gases and/or acid gases (such as, but not limited to hydrogen sulfide, carbon dioxide, and carbon monoxide).

As described herein, the water may be pure water or any aqueous solution such as those selected from the group consisting of formation water; filtered seawater; untreated seawater; natural salt water; brackish salt water; saturated salt water; synthetic brine; mineral waters; potable water containing one or more dissolved salts, minerals, and organic materials; non-potable water containing one or more dissolved salts, minerals, and organic materials; deionized water; tap water; distilled water; fresh water; or combinations thereof.

The subsurface formation 104, and thereby the multiphase formation fluid 102 may have a temperature of at least 30° C., such as from 30° C. to 80° C., from 80° C. to 100° C., from 100° C. to 150° C., from 150° C. to 200° C., from 200° C. to 400° C., or any combination of the previous ranges or smaller range therein, such as from 50° C. to 200° C. The subsurface formation 104, and thereby the multiphase formation fluid 102, may also have a pressure of at least 500 psi, such as from 500 psi to 1,000 psi, from 1,000 psi to 2,000 psi, from 2,000 psi to 3,000 psi, from 3,000 psi to 4,000 psi, from 4,000 psi to 6,000 psi, from 6,000 psi to 10,000 psi, or any combination of the previous ranges or smaller range therein, such as from 500 psi to 4,000 psi.

Still referring to FIG. 1, and as previously described, the system 100 may also comprise the packer 110. The packer 110 may be positioned within the wellbore 108, the packer 110 defining a first cavity 125 and a second cavity 127, both the first cavity 125 and the second cavity 127 extending from a top surface 124 of the packer 110 to a bottom surface 126 of the packer 110. In so having, the packer 110 may also be regarded as a dual-string packer 110. Although not illustrated, the first cavity 125 and the second cavity 127 may each include fastening means on the top surface 124 and/or the bottom surface 126 for coupling another component thereto, as explained in further detail hereinbelow. The fastening means may be any understood in the art, such as, but not limited to, male-female threaded connections. As shown in FIG. 1, the packer 110 may also comprise one or more swellable, inflatable, or radially extendible means, that, when actuated, may isolate an upper section 107 of the wellbore 108 above the packer 110 and a lower section 109 of the wellbore 108 below the packer 110, as would be understood in the art. As illustrated in FIG. 1, the lower section 109 of the wellbore 108 may also coincide with the subsurface formation 104, although this is not necessary. Without being limited by theory, such swellable, inflatable, or radially extendible means may provide isolation that may only permit flow of the multiphase formation fluid 102 through the first and second cavities of the packer 110.

Still referring to FIG. 1, and as previously described, the system 100 may also comprise the electric submersible pump 112. As illustrated in FIG. 1, the electric submersible pump 112 may comprise an electric submersible pump inlet 128 and an electric submersible pump outlet end 130. The electric submersible pump outlet end 130 may be coupled to the bottom surface 126 of the packer 110 such as at first cavity 125 through the fastening means. Also as illustrated in FIG. 1, the electric submersible pump 112 may further comprise a motor section 132, a seal section 133, and a pump section 134. The motor section 132 may be configured to supply drive to the pump section 134. The pump section 134 may be configured to lift the multiphase formation fluid 102 through the electric submersible pump 112. The seal section may be configured to prevent the multiphase formation fluid 102 from entering the motor section 132. Accordingly, the electric submersible pump 112 may be configured to produce the multiphase formation fluid 102 from the subsurface formation 104 through the electric submersible pump inlet end 128 and through the electric submersible pump outlet end 130.

As previously described, the system 100 may also comprise the gas separator 118. The gas separator 118 may comprise a multiphase formation fluid inlet 136, a gaseous phase outlet 138, and a liquid phase outlet 140, the liquid phase outlet 140 coupled to the inlet end of the electric submersible pump 112. The gas separator 118 may include, but may not be limited to, a centrifugal gas separator, a turbulent-flow gas separator, or any other category of gas separator known in the art. Accordingly, without being limited by theory, the gas separator 118 may be configured to separate at least a portion of the gaseous phase in the multiphase formation fluid 102 to produce the gaseous phase out the gaseous phase outlet 138 and the liquid phase out the liquid phase outlet 140. The liquid phase may then enter the electric submersible pump inlet end 128 where it may be lifted by the pump section 134 to the electric submersible pump outlet end 130.

Still referring to FIG. 1, and as previously described, the system 100 may also comprise the first tubing string 114. The first tubing string 114 may be coupled and fluidly connected to the top surface 124 of the packer 110, such as at the first cavity 125 through the fastening means, as well as to the surface collection point 106. Accordingly, as illustrated in FIG. 1, the first tubing string 114, the first cavity 125, the electric submersible pump 112, and the gas separator 118 may together define a first fluid pathway from the multiphase formation fluid inlet 136 of the gas separator 118 to the surface collection point 106. Accordingly, the electric submersible pump 112 may be configured to produce the multiphase formation fluid 102 from the subsurface formation 104 through the gas separator 118 and the first tubing string 114 to the surface collection point 106. The first tubing string 114 may also comprise a subsurface safety valve 115, which may be configured to block fluid flow in the first tubing string 114 when actuated, and may serve as a backup well control apparatus in the event any surface control apparatuses fail.

Still referring to FIG. 1, and as previously described, the system 100 may also comprise the second tubing string 116. The second tubing string 116 may also be coupled and fluidly connected to the top surface 124 of the packer 110, such as at the second cavity 127 through the fastening means, as well as to the surface collection point 106. Accordingly, as illustrated in FIG. 1, the second tubing string 116 and the second cavity 127 may together define a second fluid pathway from the bottom surface 126 of the packer 110 to the surface collection point 106. Accordingly, the gas separator 118 may be configured to separate at least a portion of the gaseous phase in the multiphase formation fluid 102 to produce the gaseous phase through the second tubing string 116 to the surface collection point 106. The second tubing string 116 may also comprise the subsurface safety valve 115, which may be configured to block fluid flow in the second tubing string 116 when actuated, and may serve as a backup well control apparatus in the event any surface control apparatuses fail.

Without being limited by theory, and as previously stated, by producing the gaseous phase of the multiphase formation fluid 102 into the second tubing string 116, rather than up the casing through the wellbore annulus, corrosion of the casing by one or more corrosive species within the multiphase formation fluid 102 may be avoided. For example, and without being limited by theory, the multiphase formation fluid 102 may comprise corrosive species such as chloride-containing water (which may break down to HCl at increased temperatures), carbon dioxides (formation of carbonic acid which reacts with the casing), organic chlorides (which may break down to HCl at increased temperatures), organic acids (such as napthenic acids), sulfur-containing species (can form iron sulfide upon reaction with the casing), and bacteria (bacteria-induced corrosion forming sulfur-containing species). Accordingly, producing the gaseous phase of the multiphase formation fluid 102 into the second tubing string 116 may minimize the risk of corrosion to the wellbore casing uphole of the packer 110 and thus minimize risks to wellbore stability.

As previously described, the system 100 may include the surface collection point 106. The surface collection point 106 may comprise a wellhead configured to accept the first tubing string 114 and the second tubing, such that the wellhead may be regarded as a dual-string wellhead 142. The dual-string wellhead 142 may comprise a tubing hanger 144 configured to suspend the first tubing string 114 and the second tubing string 116, as well as any associated components, from the dual-string wellhead 142. The dual-string wellhead 142 may also comprise a first wellhead flange 146 fluidly connected to the first tubing string 114 and a second wellhead flange 148 fluidly connected to the second tubing string 116. The first wellhead flange 146 may itself be fluidly connected and coupled to a first length of pipe 150, the first length of pipe 150 of which may be fluidly connected and coupled to a downstream choke valve 152. Similarly, the second wellhead flange 148 may itself be fluidly connected and coupled to a second length of pipe 154, the second length of pipe 154 of which may be fluidly connected and coupled to a downstream check valve 156. Also as illustrated in FIG. 1, a third length of pipe 158 may be fluidly connected and coupled to the downstream choke valve 152, the downstream check valve 156, and a treatment facility 160. The downstream choke valve 152 may be fluidly connected to and coupled to the third length of pipe 158 upstream of the downstream check valve 156. The downstream choke valve 152 may be configured to be adjustable such that the flow rate and outlet pressure of the liquid phase of the multiphase formation fluid 102 may be adjustable. The treatment facility 160 may comprise one or more hydrocarbon refining units, such as separators, reactors, dehydration systems, sweetening systems, or the like.

As previously described, the system 100 may include the electric submersible pump 112. However, the system 100 may additionally comprise a power source 162 positioned at the surface collection point 106 to provide power to the electric submersible pump 112. Additionally, as shown in FIG. 1, system 100 may also comprise one or more power cables 164, the one or more power cables 164 extending from the power source 162 to the electric submersible pump 112 and electrically coupled to both the power source 162 and the electric submersible pump 112.

As shown in FIG. 1, the one or more power cables 164 may extend from the power source 162 to the electric submersible pump 112 through the second tubing string 116 and the second cavity 127 of the packer 110. Without being limited by theory, threading the one or more power cables 164 within the second tubing string 116 rather than external to the second tubing string 116 may allow a simpler packer 110 to be used in the systems and methods herein. Particularly, an additional cavity may not need to be opened or manufactured into the packer 112 to receive the one or more power cables. Accordingly, this may reduce the risk of the one or more power cables 164 being severed, the risk of which may be exacerbated in directional wellbores. Similarly, threading the one or more power cables 164 within the second tubing string 116 may obviate the need for a packer penetrator and/or splices for the one or more power cables 164 to form the additional cavity for receiving the one or more power cables 164.

In embodiments, the one or more power cables 164 may each comprise an electrically conductive core surrounded by a lining material. The one or more power cables 164 may also each comprise a reinforcement material interposed between the electrically conductive core and the lining material or surrounding the lining material. The reinforcement material may be configured to support the weight of the one or more power cables 164 in the wellbore 108. However, in some embodiments, the electrically conductive core and the lining material may themselves by sufficient to support the weight of the one or more power cables 164.

As previously stated, the one or more power cables 164 may extend through the second tubing string 116. As shown in FIG. 1, the power source 162 may be external to the second tubing string 116. Accordingly, to enable the one or more power cables 164 to be connected between the electric submersible pump 112 and the power source 162 while extending through the second tubing string 116, one of the tubing hanger 144, the second tubing string 116, the dual-string wellhead 142, the second wellhead flange 148, or the second length of pipe 154, (or in general any item fluidly connected to the second tubing string 116), may further comprise an adapter 165 for receiving the one or more power cables 164 into the second tubing string 116.

It is contemplated that the one or more power cables 164 may be provided, at least initially, in the form of a spool. Accordingly, to enable the one or more power cables 164 to be inserted into the second tubing string 116 and connected to the ESP 130, the one or more power cables 164 may be pre-threaded through one or more tubing joints making up the second tubing string 116, the second cavity 127, the tubing hanger 144, the dual-string wellhead 142, the second wellhead flange 148, the second length of pipe, or combinations thereof prior to insertion of the ESP 130, the gas separator 136, the packer 110, the first tubing string 114, and the second tubing string 116 into the wellbore. In such an embodiment, the one or more power cables may be initially inserted into the second tubing string through the adapter 165. Further, in embodiments in which the second tubing string 116 further comprises the subsurface safety valve, the adapter 165 for receiving the one or more power cables 164 may be positioned on one of the tubing joints making up the second tubing string downhole of the subsurface safety valve 115. In such an embodiment, the dual-string wellhead 142 may further comprise one or more channels 166, such as within the tubing hanger 144, for receiving the one or more power cables 164 into the wellbore.

While the one or more power cables 164 are stated to be electrically coupled to the electric submersible pump 112, where the electric submersible pump 112 includes the motor section 132 and the pump section 134, the one or more power cables 164 may actually be electrically coupled to the motor section 132.

Still referring to FIG. 1, the system 100 may also comprise a plurality of tubing clamps 170 spaced along the length of the first tubing string 114. The plurality of tubing clamps 170 may be coupled to the first tubing string 114 and the second tubing string 116, and thus secure the first and second tubing strings 114/116. In at least some embodiments, at least some of the plurality of tubing clamps 170 may also be coupled to the one or more power cables 164 for securing the one or more power cables 164 in a fixed line position uphole of the adapter 165 and preventing the one or more power cables 164 from wrapping around the first tubing string 114, the second tubing string 116, or both and risking the integrity of the adapter 165. Although not illustrated in FIG. 1, the upper section 107 may be filled with an inhibited fluid, such as an inhibited brine, to protect the casing of the wellbore 108 from corrosion, as well as to provide a pressure seal against the packer 110 leaking multiphase formation fluid 102 to the surface collection point 106 through the upper section 107.

As previously stated, embodiments herein may also be directed to methods for multiphase formation fluid 102 production utilizing the electric submersible pump 112. The methods may initially comprise providing any of the systems 100 previously mentioned. The method may then comprise actuating the packer 110 to isolate the upper section of the wellbore 108 and the lower section of the wellbore 108. The method may then comprise producing the liquid phase of the multiphase formation fluid 102 along the first tubing string 114 utilizing the electric submersible pump 112. The method may also comprise producing the gaseous phase of the multiphase formation fluid 102 along the second tubing string 116 utilizing the gas separator 118.

It is noted that recitations herein of a component of the present embodiments being "operable" or "sufficient" in a particular way, to embody a particular property, or to function in a particular manner, are structural recitations, as opposed to recitations of intended use. More specifically, the references in the present embodiments to the manner in which a component is "operable" or "sufficient" denotes an existing physical condition of the component and, as such, is to be taken as a definite recitation of the structural characteristics of the component.

The singular forms "a," "an" and "the" include plural referents, unless the context clearly dictates otherwise.

Herein, ranges are provided. It is envisioned that each discrete value encompassed by the ranges are also included. Additionally, the ranges which may be formed by each discrete value encompassed by the explicitly disclosed ranges are equally envisioned.

As used herein and in the appended claims, the words "comprise," "has," and "include" and all grammatical variations thereof are each intended to have an open, non-limiting meaning that does not exclude additional elements or steps.

As used herein, terms such as "first" and "second" are arbitrarily assigned and are merely intended to differentiate between two or more instances or components. It is to be understood that the words "first" and "second" serve no other purpose and are not part of the name or description of the component, nor do they necessarily define a relative location, position, or order of the component. Furthermore, it is to be understood that the mere use of the term "first" and "second" does not require that there be any "third" component, although that possibility is contemplated under the scope herein.

Having described the subject matter herein in detail and by reference to specific embodiments, it is noted that the various details disclosed herein should not be taken to imply that these details relate to elements that are essential components of the various embodiments described herein. Further, it will be apparent that modifications and variations are possible without departing from the scope herein, including, but not limited to, embodiments defined in the appended claims.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising."

What is claimed is:

1. A system for producing a multiphase formation fluid from a subsurface formation utilizing an electric submersible pump (ESP), the system comprising:

a surface collection point;

a power source positioned at the surface collection point;

a wellbore extending from the surface collection point to the subsurface formation;

a packer positioned within the wellbore, the packer defining a first cavity and a second cavity, both the first cavity and the second cavity extending from a top surface of the packer to a bottom surface of the packer;

the ESP comprising an ESP inlet end and an ESP outlet end, the ESP outlet end coupled to the bottom surface of the packer at the first cavity;

a gas separator comprising a multiphase formation fluid inlet, a gaseous phase outlet, and a liquid phase outlet, the liquid phase outlet coupled to the ESP inlet end;

a first tubing string coupled to the top surface of the packer at the first cavity, wherein the first tubing string, the ESP, and the gas separator together define a first fluid pathway from the multiphase formation fluid inlet to the surface collection point;

a second tubing string coupled to the top surface of the packer at the second cavity, the second tubing string and the packer together defining a second fluid pathway from the bottom surface of the packer to the surface collection point; and one or more power cables extending from the power source through the second tubing string and second cavity to the ESP, the one or more power cables electrically coupled to the ESP and the power source, and wherein;

the gas separator is configured to separate a gaseous phase of the multiphase formation fluid to produce the gaseous phase through the second tubing string to the surface collection point, and the ESP is configured to produce a liquid phase of the multiphase formation fluid from the subsurface formation through the gas separator and the first tubing string to the surface collection point.

2. The system of claim 1, wherein the ESP further comprises a motor section, a seal section and a pump section, the motor section configured to supply drive to the pump section, the seal section configured to prevent the multiphase formation fluid from entering the motor section, and the pump section configured to lift the multiphase formation fluid through the gas separator and the first tubing string to the surface collection point.

3. The system of claim 1, wherein the second tubing string comprises an adapter for receiving the one or more power cables into the second tubing string.

4. The system of claim 1, wherein the one or more power cables comprise an electrically conductive core surrounded by a lining material.

5. The system of claim 1, further comprising a plurality of tubing clamps spaced along the length of the first tubing string, wherein the plurality of tubing clamps are coupled to both the first tubing string and the second tubing string.

6. The system of claim 1, wherein the surface collection point comprises a dual-string wellhead having a first wellhead flange fluidly connected to the first tubing string and a second wellhead flange fluidly connected to the second tubing string.

7. The system of claim 6, wherein the dual-string wellhead comprises a tubing hanger configured to suspend the first tubing string and the second tubing string from the dual-string wellhead.

8. The system of claim 6, wherein the dual-string wellhead further comprises:

a first length of pipe fluidly connected to the first wellhead flange and a downstream choke valve;

a second length of pipe fluidly connected to the second wellhead flange and a downstream check valve; and a third length of pipe fluidly connected to the downstream choke valve, the downstream check valve, and a treatment facility, wherein the downstream choke valve is fluidly connected to the third length of pipe upstream from the downstream check valve.

9. The system of claim 8, wherein the treatment facility comprises one or more hydrocarbon refining units.

10. The system of claim 1, wherein the second tubing string comprises an adapter for inserting the one or more power cables into the second tubing string.

11. The system of claim 1, wherein the gas separator comprises a centrifugal gas separator or a turbulent-flow gas separator.

12. The system of claim 1, wherein the surface collection point comprises a dual-string wellhead comprising:

a first wellhead flange fluidly connected to the first tubing string;

a second wellhead flange fluidly connected to the second tubing string;

a tubing hanger configured to suspend the first tubing string and the second tubing string from the dual-string wellhead;

a first length of pipe fluidly connected to the first wellhead flange and a downstream choke valve;

a second length of pipe fluidly connected to the second wellhead flange and a downstream check valve; and a third length of pipe fluidly connected to the downstream choke valve, the downstream check valve, and a treatment facility wherein the downstream choke valve is fluidly connected to the third length of pipe upstream from the downstream check valve.

13. The system of claim 12, wherein one of the tubing hanger, the second tubing string, the dual-string wellhead, the second wellhead flange, or the second length of pipe comprises an adapter for receiving the one or more power cables into the second tubing string.

14. The system of claim 1, wherein the multiphase formation fluid comprises hydrocarbons.

15. A method of utilizing the system of claim 1, the method comprising:

producing the liquid phase of the multiphase formation fluid along the first tubing string utilizing the ESP; and producing the gaseous phase of the multiphase formation fluid along the second tubing string utilizing the gas separator.

16. The method of claim 15, further comprising actuating the packer prior to producing the liquid phase.

17. The method of claim 15, wherein the surface collection point of the system further comprises a dual-string wellhead comprising:

a first wellhead flange fluidly connected to the first tubing string;

a second wellhead flange fluidly connected to the second tubing string;

a tubing hanger configured to suspend the first tubing string and the second tubing string from the dual-string wellhead;

a first length of pipe fluidly connected to the first wellhead flange and a downstream choke valve;

a second length of pipe fluidly connected to the second wellhead flange and a downstream check valve; and a third length of pipe fluidly connected to the downstream choke valve, the downstream check valve, and a treatment facility, and wherein one of the tubing hanger, the second tubing string, the dual-string wellhead, the second wellhead flange, or the second length of pipe comprises an adapter for receiving the one or more power cables into the second tubing string.

18. The method of claim 15, wherein the gas separator comprises a centrifugal gas separator or a turbulent-flow gas separator.

19. The method of claim 15, wherein the subsurface formation further comprises hydrocarbons.

* * * * *